US005575010A

United States Patent [19]

Chung

[11] Patent Number: 5,575,010

[45] Date of Patent: Nov. 19, 1996

[54] PANTS WITH ADJUSTABLE WAIST AND LENGTH

[76] Inventor: Chin-Fu Chung, No. 898, Min-Sheng St., Kuei-Jen Hsiang, Tainan Hsien, Taiwan

[21] Appl. No.: 532,148

[22] Filed: Sep. 22, 1995

[51] Int. Cl.[6] ..... A41D 27/10; A41D 1/06

[52] U.S. Cl. ..... 2/227; 2/237; 2/269; 2/270

[58] Field of Search ..... 2/227, 231, 232, 2/236, 237, 269, 270, 919, 80, 83, 221, 76

[56] References Cited

U.S. PATENT DOCUMENTS

| | | | |
|---|---|---|---|
| 701,252 | 5/1902 | Bandler | 2/237 |
| 1,065,554 | 6/1913 | Schneider | 2/237 |
| 1,709,508 | 4/1929 | Weiner et al. | 2/237 |
| 2,280,416 | 4/1941 | Young | 2/227 |
| 2,923,009 | 2/1960 | Cookman | 2/227 |
| 3,040,331 | 6/1962 | Lampkowitz | 2/237 |
| 3,823,419 | 7/1974 | Breitbart | 2/237 |
| 4,149,275 | 4/1979 | Sanchez | 2/269 |
| 4,200,938 | 5/1980 | LeTourneau | 2/269 |
| 4,893,358 | 1/1990 | Bice, Jr. | 2/237 |
| 4,985,936 | 1/1991 | Jones | 2/269 |
| 5,033,125 | 7/1991 | de la Villefromoy et al. | 2/237 |
| 5,088,128 | 2/1992 | Kape | 2/269 |

*Primary Examiner*—Amy B. Vanatta
*Attorney, Agent, or Firm*—Varndell Legal Group

[57] ABSTRACT

A pair of pants in which a plurality of snaps are mounted around the waistband for adjusting its size, and hook & loop materials are fastened to the inside of the legs for adjusting their length.

2 Claims, 5 Drawing Sheets

PANTS WITH ADJUSTABLE WAIST AND LENGTH

BACKGROUND OF THE INVENTION

The present invention relates to pants, and relates more particularly to such a pair of pants which can be conveniently adjusted to change the size of the waistband and the length of the legs.

When designing clothes, clothes makers commonly emphasize the variation of colors and styles so as to create a fashion. A regular pair of paints, as shown in FIG. 1, is generally comprised of a waistband and two legs. Because the size of the waistband and the length of the legs are not adjustable, when the user's body size is changed, the pants become useless.

SUMMARY OF THE INVENTION

According to the present invention, a plurality of male fastening elements and female fastening elements are alternatively mounted around the waistband of the pants for fastening with one another to change the size of the waistband; each leg of the pants comprises two symmetrical parts fastened by two zippers, a hook tape fixedly secured to the inside near the bottom end, and a plurality of loop tapes fixedly secured to the inside and vertically spaced between the hook tape and the top ends of the zippers for fastening the hook tape when each covering is inwardly folded up to change the length of each leg.

DETAILED DESCRIPTION OF THE PREFERRED EMBODIMENT

Figure 1:
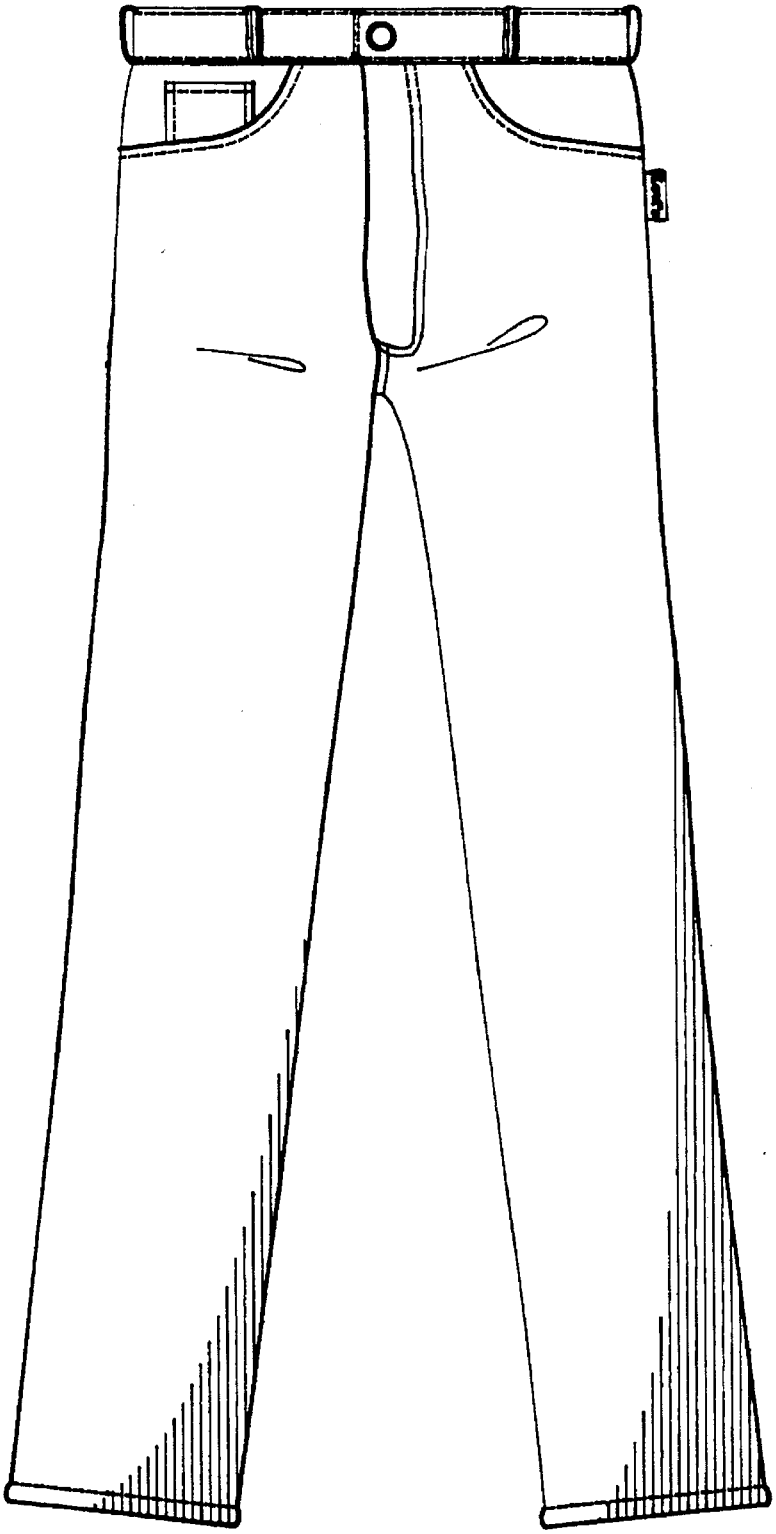
Fig. 1 PRIOR ART
FIG. 1 shows a pair of conventional pants.
Figure 2:
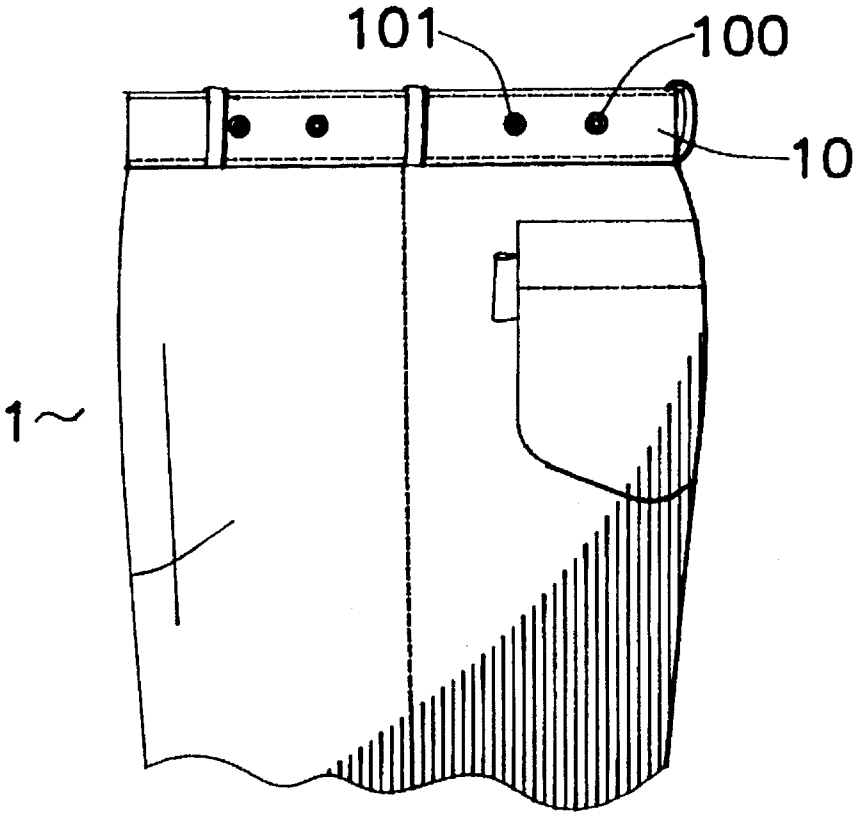
FIG. 2 shows the upper part of a pair of pants according to the present invention.
Figure 3:
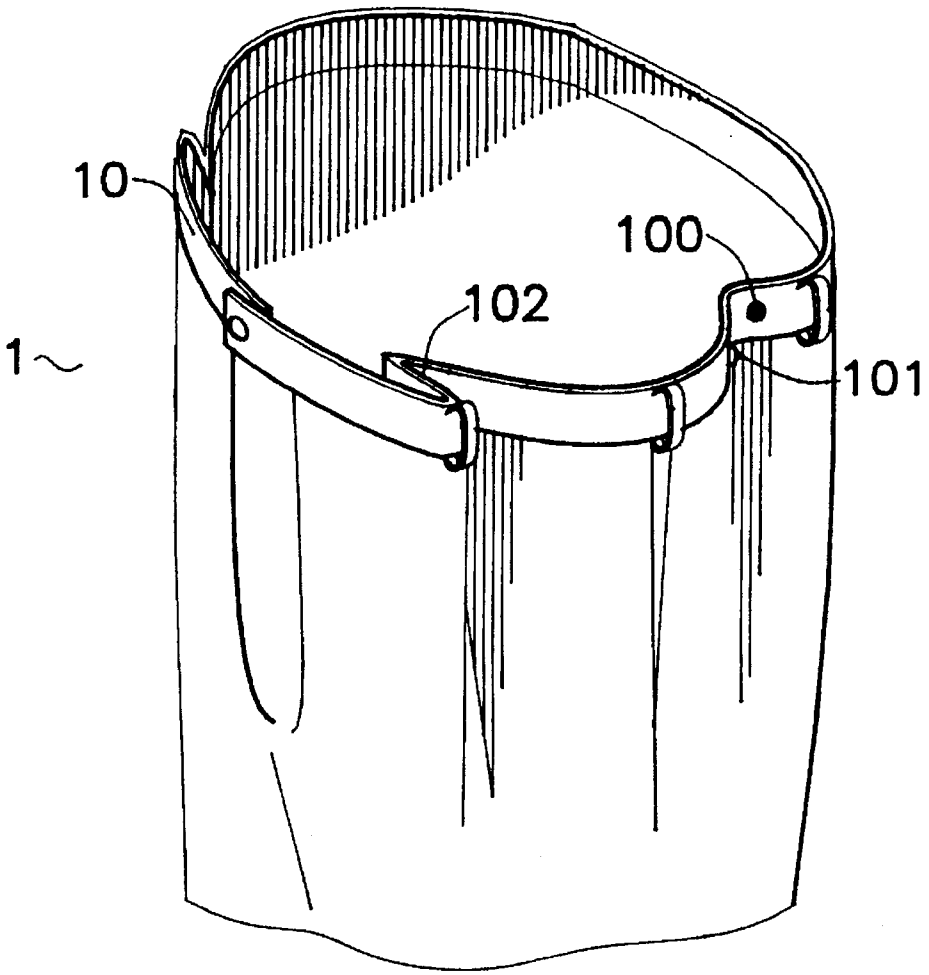
FIG. 3 shows the waistband of the pair of pants of FIG. 2 folded up.

Referring to FIGS. 2 and 3, a plurality of ball sides 100 and socket sides 101 are alternatively mounted around the waistband 10 of a pair of pants 1 (one ball side 100 and one socket side 101 form a snap). When one ball side 100 is fastened to one socket side 101, a fold 102 is formed at the waistband 10. Therefore, the size of the waistband 10 can be adjusted.

Figure 4:
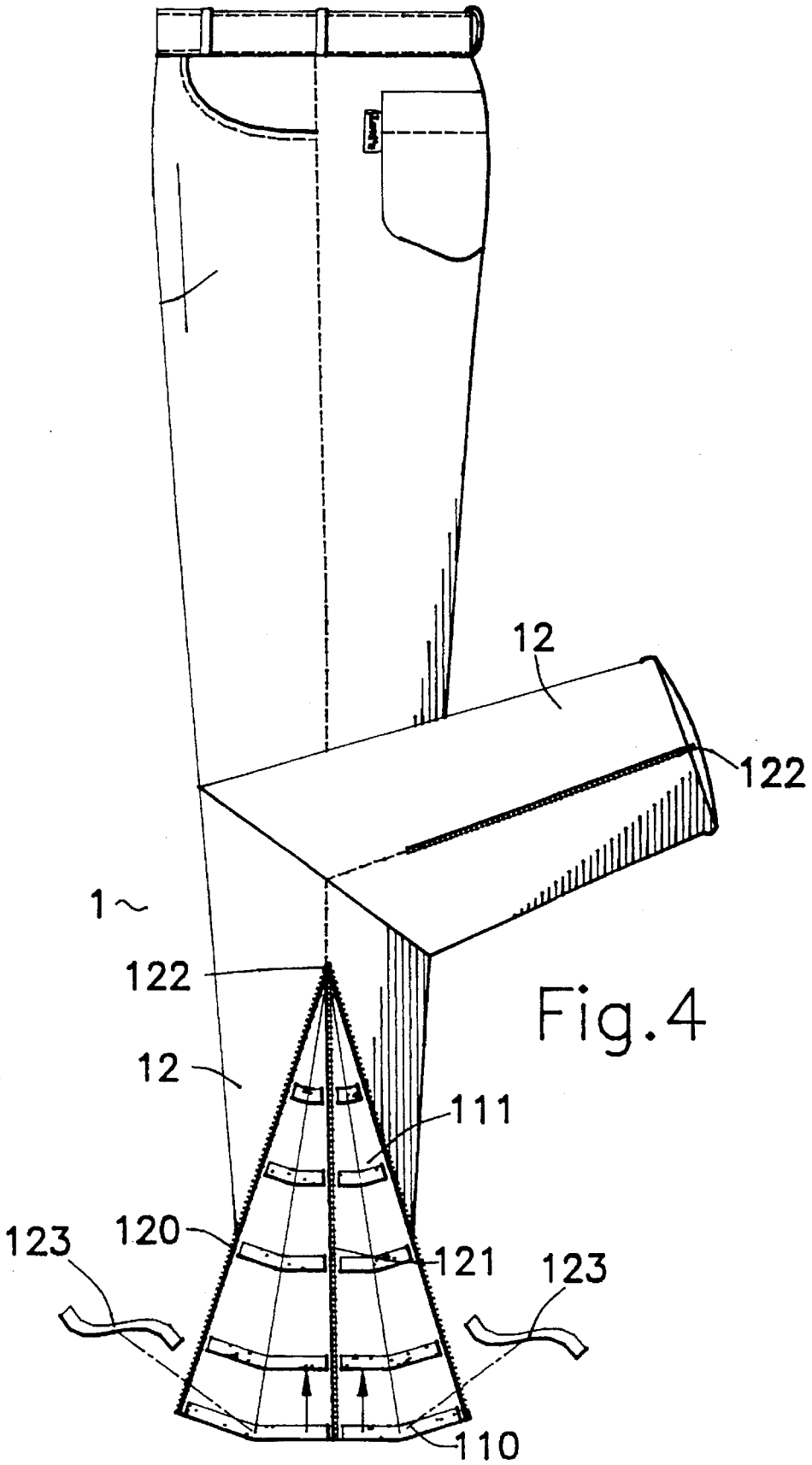
FIG. 4 shows the inside structure of the one leg of the pair of pants of FIG. 2.
Figure 5:
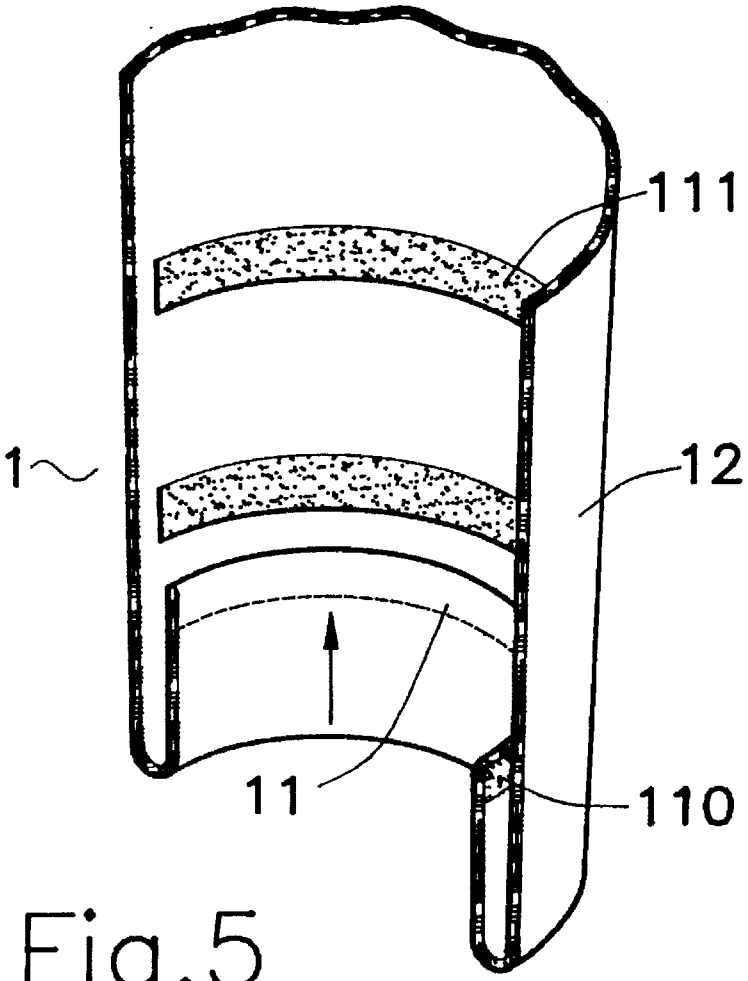
FIG. 5 is a partial view of one leg of the pair of pants of FIG. 2, showing the bottom end of the leg inwardly folded up.

Referring to FIGS. 4 and 5, each leg 12 of the pants (or pant leg) 1 is comprised of two symmetrical parts fastened by two zippers 120 and 121. A hook tape 110 is fixedly secured to the bottom 11 of each leg 12 around the inside wall. A loop tape 123 is detachably fastened to the hook tape 110 A plurality of vertically spaced loop tapes 111 are respectively fixed to each leg around the inside wall between the bottom 11 and top ends 122 of the zippers 120 and 121. Therefore, the length of the legs 12 can be adjusted by inwardly folding up the legs 12 and fastening the hook tape 110 to one loop tape 111. When the zippers 120 and 121 are unfastened, the legs 12 can be conveniently folded up. When legs 12 are fully extended out, the loop tape 123 is fastened to the hook tape 110 to prevent the hook tape 110 from rubbing against the skin of the user's leg.

I claim:

1. A pair of pants comprising a waistband and two pant legs, wherein said waistband is a continuous piece of material including male fastening elements and female fastening elements mounted around said waistband in an alternating order of a male fastening element and a female fastening element for fastening with one another and changing a size of said waistband; said pant legs are symmetrical and respectively have a bottom and an inside, a zipper arranged at said bottom, a hook tape fixedly secured to said inside near said bottom end, and a plurality of vertically spaced loop tapes fixedly secured to said inside for fastening said hook tape when said pant leg is inwardly folded up, said zipper opens downward and extends upward only along a portion of said pant leg.

2. The pair of pants of claim 1, further comprising an additional loop tape for fastening to said hook tape when said pant legs are fully extended to prevent said hook tape from rubbing against skin of a wearer of said pair of pants.

* * * * *